US010414473B2

(12) United States Patent
Ledda et al.

(10) Patent No.: US 10,414,473 B2
(45) Date of Patent: Sep. 17, 2019

(54) SUBSEA STRUCTURE CLEANING APPARATUS AND METHOD

(71) Applicant: OCEANEERING INTERNATIONAL, INC., Houston, TX (US)

(72) Inventors: Jeffery Neal Ledda, Prince Frederick, MD (US); Duane Martin Baker, III, Glen Burnie, MD (US); Bruce Brian Brown, Severna Park, MD (US); Anthony Louis Kopera, Baltimore, MD (US); George Kotula, Crownsville, MD (US); Thomas Knight Tolman, Annapolis, MD (US); Gary Wieboldt, Annalpolis, MD (US); Christopher Embree Wong, Cockeysville, MD (US)

(73) Assignee: Oceaneering International, Inc., Houston, TX (US)

( * ) Notice: Subject to any disclaimer, the term of this patent is extended or adjusted under 35 U.S.C. 154(b) by 782 days.

(21) Appl. No.: 14/706,362

(22) Filed: May 7, 2015

(65) Prior Publication Data

US 2016/0001857 A1 Jan. 7, 2016

Related U.S. Application Data

(60) Provisional application No. 61/989,955, filed on May 7, 2014.

(51) Int. Cl.
*B63B 59/10* (2006.01)
*B63B 59/08* (2006.01)

(52) U.S. Cl.
CPC ..... *B63B 59/10* (2013.01); *B63B 59/08* (2013.01)

(58) Field of Classification Search
CPC ..... B63B 59/00; B63B 59/08; B63B 59/10; B63B 59/06; B63G 8/00; B63G 8/08; B63G 8/14
(Continued)

(56) References Cited

U.S. PATENT DOCUMENTS 5,174,222 A * 12/1992 Rogers ..... B63B 59/08 114/222
5,947,051 A * 9/1999 Geiger ..... B63B 59/10 114/222

(Continued)

*Primary Examiner* — Lars A Olson
(74) *Attorney, Agent, or Firm* — Maze IP Law, P.C.

(57) ABSTRACT

The invention relates to an apparatus and related method for cleaning vessel hulls and other subsea structures at sea. In an embodiment, a hull cleaning system comprises a housing defining an interior void; a multifunction bar; a propulsion system; a power system; a positioning system; a water pump operatively connected to the power system; a high flow manifold operatively in fluid communication with the water pump; a hull cleaner; and a suction device configured to selectively adhere the hull cleaning system to a hull. In a further embodiment, a remotely operated work class vehicle, which is typically able to be deployed from any platform outfitted to accept its launch, recovery and support equipment and which may further be innately unstable when not adhered to an underwater structure such as when flying through open water, comprises a frame; an inspection sensor; a hydraulically powered, high pressure water jet pump; a predetermined tooling set connected to the housing; and a propulsion system, which includes a suction device, configured to propel the remotely operated work class vehicle about a surface.

19 Claims, 9 Drawing Sheets

(58) Field of Classification Search
USPC ..... 114/222
See application file for complete search history.

(56) References Cited

U.S. PATENT DOCUMENTS 9,308,977 B2 * 4/2016 Andersen ..... B63B 59/08
9,434,456 B2 * 9/2016 Hojer ..... B63B 59/08

* cited by examiner

Rotary Head-2 Nozzle

SUBSEA STRUCTURE CLEANING APPARATUS AND METHOD

RELATION TO PRIOR APPLICATIONS

This application claims the benefit of, and priority through, U.S. Provisional Application 62/069,428, titled "Vessel Hull Cleaning Apparatus And Method," filed May 7, 2014.

FIELD OF THE INVENTION

The invention relates generally apparatuses and methods related to cleaning subsea structures such as vessel hulls and the risers and the like while at sea.

BACKGROUND OF THE INVENTION

Many issues are currently facing the remotely operated vehicle (ROV) market, giving rise to a need for simplification of operations and maintenances, near zero fluid emissions, configurable and scalable intervention capabilities, and power management between ROV system and tools. These issues include accessing structures subsea, such as vessel hulls and risers, for inspection and/or cleaning.

FIGURES

The figures supplied herein disclose various embodiments of the claimed inventions.

DESCRIPTION OF VARIOUS EMBODIMENTS

Figure 1:
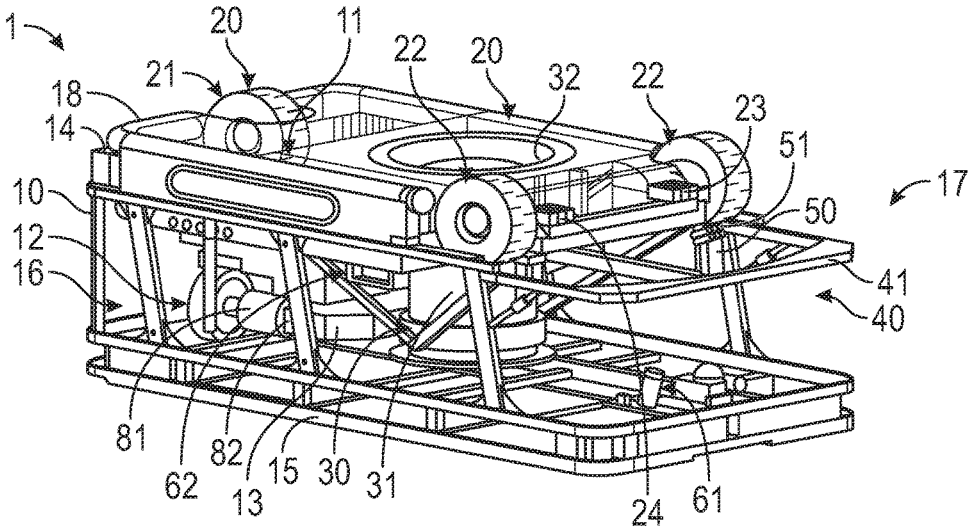
FIG. 1 is view in partial perspective of an exemplary embodiment of a vessel hull cleaning apparatus.

In general, the invention described generally herein can divert all or a portion of main power from a remotely operated vehicle (ROV) to tooling systems, skids, and external systems. The disclosed ROV portion of the disclosed subsea structure cleaning system 1 (FIG. 1) can share or turn over its control systems to tooling systems, including skids and external systems. In configurations which are modular, subsea structure cleaning system 1 may be designed to be readily upgradeable Referring generally to FIG. 1, in a first embodiment subsea structure cleaning system 1, which may be configured to be deployed as a work-class ROV capable support vessel, comprises housing 10 comprising upper side 14 and interior void 16, propulsion system 20, typically comprising set of wheels, such as wheels 21 and 22 which typically comprise rubber, disposed about a predetermined portion of upper side 14 of housing 10, at least one wheel 21 of the set of wheels configured to be steerable and extending outward from housing 10 with respect to interior void 16; wheel driver 23 operatively connected to one or more driven wheels 22 of the set of wheels, driven wheels 22 extending outward from housing 10 with respect to interior void 16; power system 80 (FIG. 2); positioning system 70 (not specifically shown in the figures) operatively connected to power system 80; multifunction bar 40 extending from side portion 17 of housing 10; water pump 12 disposed at least partially within interior void 16 and operatively connected to power system 80; high flow manifold 13 disposed at least partially within interior void 16 and operatively in fluid communication with water pump 12; subsea structure cleaner 50; and suction device 30 configured to selectively adhere subsea structure cleaning system 1 to vessel hull 2 (FIG. 11) or similar surface.

In its inspection modes, subsea structure cleaning system 1 may provide for inspection and termination of thickness of a subsea structure such as vessel hull 2 (FIG. 11) such as via an ultrasonic sensor; for alternating current field measurement, for close-up and/or general visual inspection of a subsea structure such as vessel hull 2; and/or for navigation/data management. As described below, its cleaning capabilities may comprise resident light biofouling removal from of a subsea structure such as vessel hull 2.

Housing 10 may comprise a low profile/hydrodynamic form configured to minimize drag. In typical configurations, subsea structure cleaning system 1 is configured to be neutrally buoyant. In other configurations, subsea structure cleaning system 1 is configured to have a slightly negative buoyancy configured to allow subsea structure cleaning system 1 to sink away from a subsea structure such as vessel hull 2 (FIG. 7) on loss of power. Float 11 may be present and, if present, comprise a fixed ballast, typically one or more foam layers. Active buoyancy controller 18 may also be present and substituted for one or more foam layers. Active buoyancy controller 18 would act to move the vehicle center of buoyancy in order to change the orientation of the vehicle in water.

Figure 6:
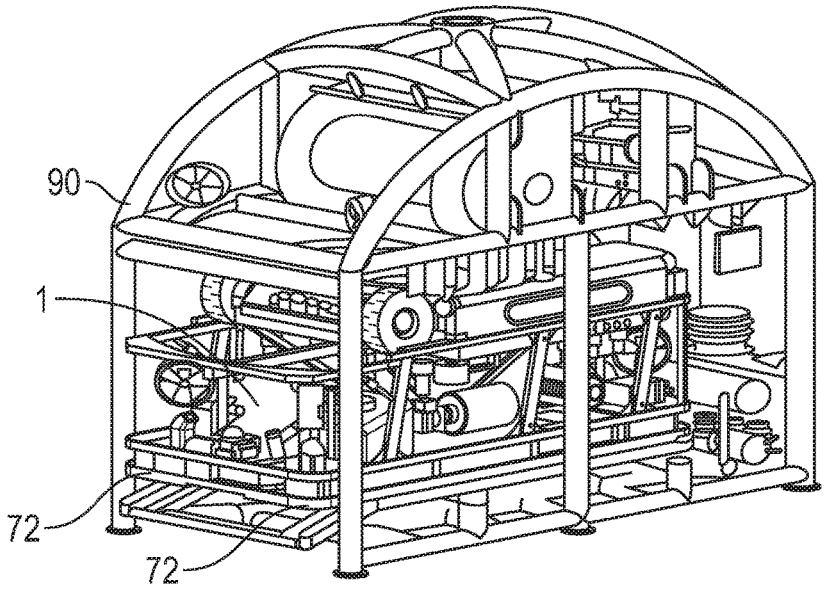
FIG. 6 is view in partial perspective of an exemplary embodiment of a vessel hull cleaning apparatus in an exemplary cage.

Positioning system, generally referred to herein as "70" but not specifically shown in the figures, may comprise one or more thrusters such as one or more front thrusters 71 (FIG. 2), one or more additional thrusters such as rear thrusters 72 (FIG. 6), or the like, or a combination thereof. Suction device 30 is typically disposed at least partially within interior void 16 and comprises orifice 32 and impeller 31, typically a suction impeller configured to allow adherence to vertical as well as horizontal surfaces such as hull surfaces. Impeller 31 also may be configured to provide vertical thrust.

Subsea structure cleaning system 1 is typically configured to be powered hydraulically but may be configured as a standalone, host independent system. Power system 80 (FIG. 2) may comprise one or more electric motors 81 operatively connected to water pump 12, one or more hydraulic power systems 82 operatively connected to high flow manifold 13, or the like, or a combination thereof.

Figure 2:
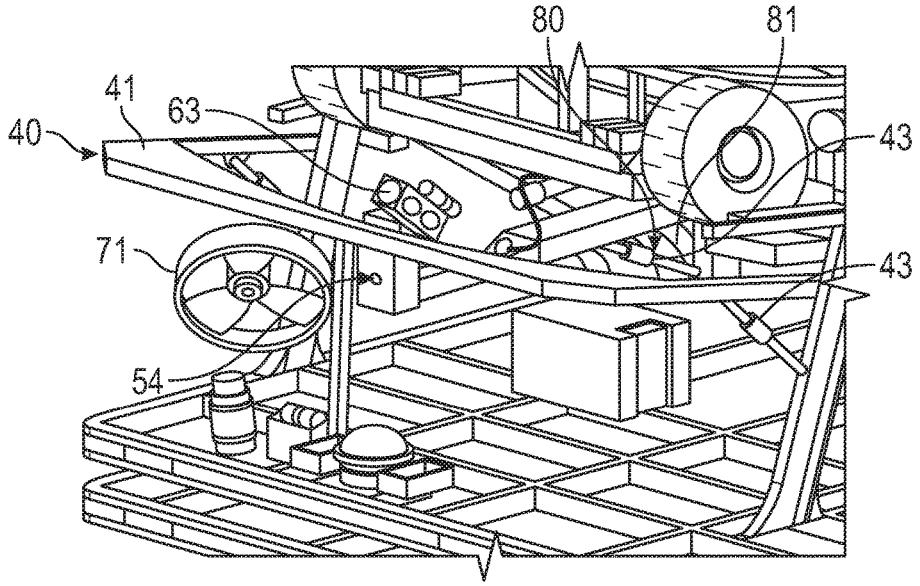
FIG. 2 is view in partial perspective of a side of an exemplary embodiment of a vessel hull cleaning apparatus.

Referring additionally to FIG. 2, multifunction bar 40 is typically configured to be selectively raised and lowered such as by using one or more using actuators 43 connected to power system 80 and to multifunction bar 40. In certain configurations, multifunction bar 40 comprises one or more cleaning tools 100 configured to address specific types of bio-fouling and/or to position subsea structure cleaning system 1 for cleaning such as hard fouling scrapers 101 and/or one or more tool carrier interchanges 102 adapted to accept one or more rotary brushes 103, rotary nozzles 104, liner brush/grinders 104, or the like, or a combination thereof. In general, nozzles 104 may have 3 or more degrees of freedom. Cleaning tools 100 may also be configured to position subsea structure cleaning system 1 for cleaning and to accept a manipulator such as a manipulator attached to a commercial work class ROV (not shown in the figures).

Cleaning tools may further comprise diver hand held tools and/or one or more wiper arm-HP water cleaner 56 attached to wiper arm-cleaner 50 which may be configured to be movable in two or more directions. Wiper arm-HP water cleaner 56 may further comprise one or more nozzle carrier interchanges 53 which may be movable independently of wiper arm-HP water cleaner 56. Nozzle carrier interchange 56 itself may be attached to or replacing manipulator arm 40 and configured to accept one or more rotary heads 56, one or more telescoping nozzles 57, one or more riser cleaning tools 54, or the like, or a combination thereof. In certain configurations, nozzle carrier interchange 56 is further configured to accept one or more inspection sensor carriers 55.

Sonar 61 may be present, either independently or along with wiper arm-HP water cleaner 56 which may be attached to wiper arm-cleaner 50, and configured to allow sonar triangulation using range/bearing and known geometry of hulls and risers to provide vehicle position and orientation of subsea structure cleaning system 1. Sonar 61 used in may be used in combination with sensors such as wheel encoders and/or visual cameras to determine position and orientation of subsea structure cleaning system 1 and/or wiper arm-HP water cleaner 56 attached to wiper arm-cleaner 50.

If present, a turret-style floating production, storage and offloading (FPSO) unit may require additional target markers.

Wheel driver controller 24 may be present onboard subsea structure cleaning system 1 and operatively in communication with wheel driver 23. Wheel driver controller 24 is typically configured to provide multiple driving modes such as in-flight maneuvering to vessel hull 2 (FIG. 7) like an ROV, transitioning to/from free-flyer to hull crawler (and vice-versa); and driving on vessel hull 2 like a crawler and clean. Driven wheel 22 may comprise two or more fixed wheels 22 extending outward from housing 10 with respect to interior 16.

Figure 11:
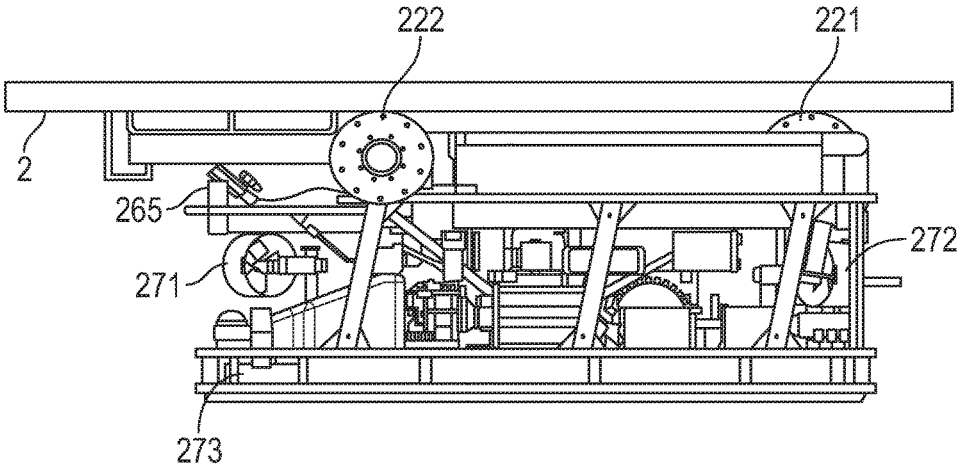
FIG. 11 is view in partial perspective of a side of an exemplary embodiment of a vessel hull cleaning apparatus.

Although propulsion system 20 typically comprises one or more wheels 20, other embodiments are envisioned. By way of example and not limitation, propulsion system 20 may comprise crawling track 25 (FIG. 3) configured to provide controlled movement on a surface such as vessel hull 2 (FIG. 11).

Figure 5:
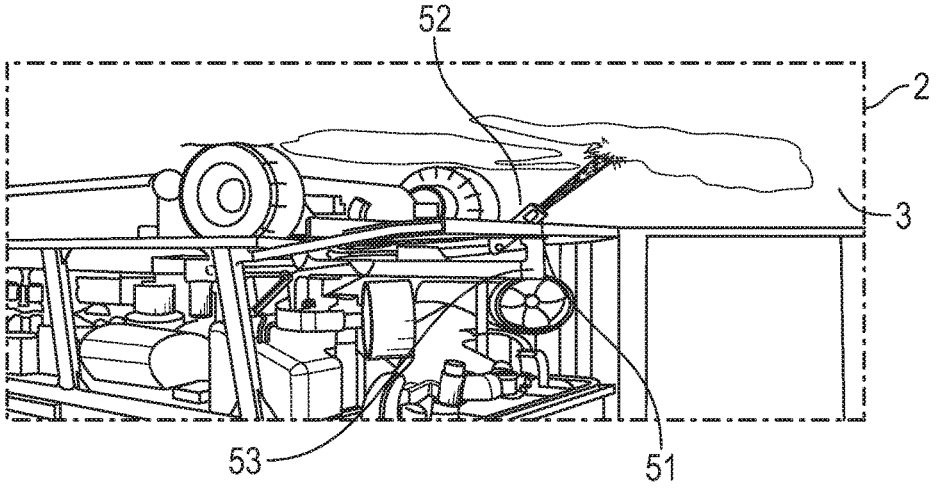
FIG. 5 is view in partial perspective of a side of an exemplary embodiment of a vessel hull cleaning apparatus illustrating a cavitating water jet.

Subsea structure cleaner 50, which may be configured as a vessel hull cleaner, in embodiments comprises one or more cavitating water jets 51 (FIG. 5), comprising one or more cleaning nozzles 52, and/or one or more brushes 103 located on manipulator arm 40, powered by power system 80. Cavitating water jet 51 may be configured for cleaning duties such as, by way of example and not limitation, cleaning weld seams, intakes and the like on bottom and sides of FPSOs to support underwater inspection in lieu of dry dock (UWILD) tasks. By way of example and not limitation, subsea structure cleaning system 1 may also provide one or more remote and/or diver assisted UWILD interchangeable tools or other hand held tools.

Figure 14:
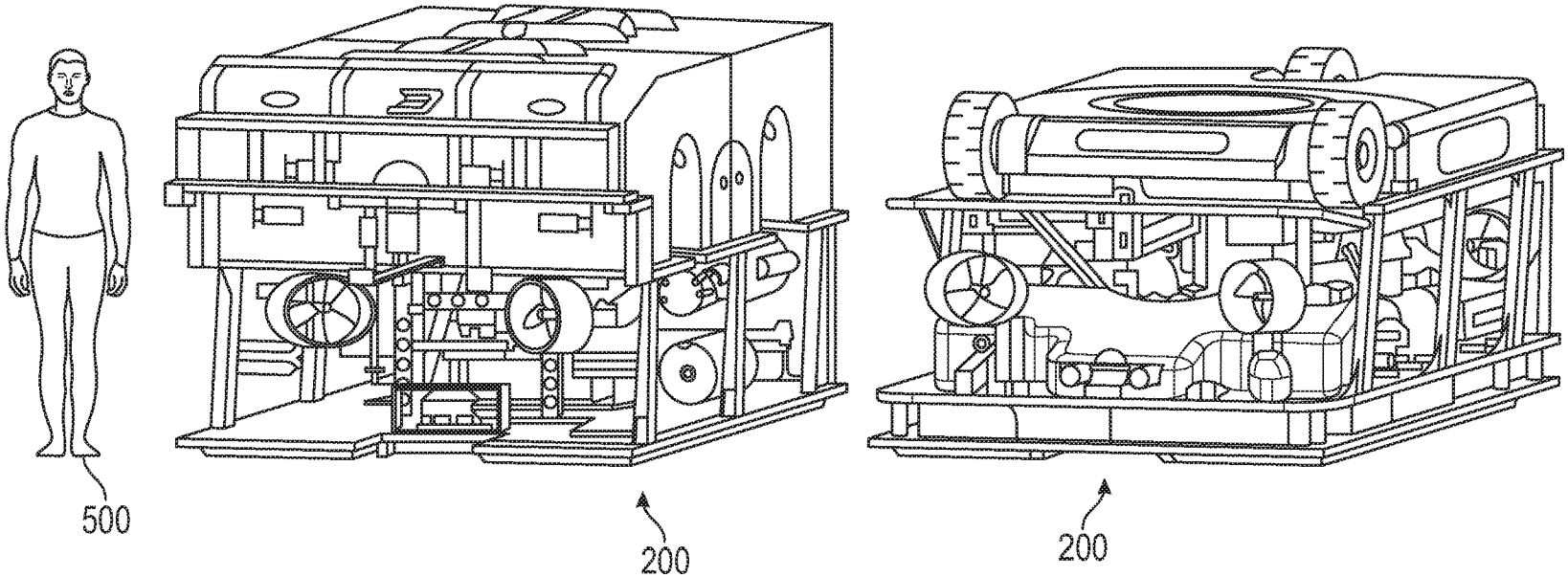
FIG. 14 is view in partial perspective of a side view of an exemplary embodiment of a vessel hull cleaning apparatus and a diver.
Figure 15:
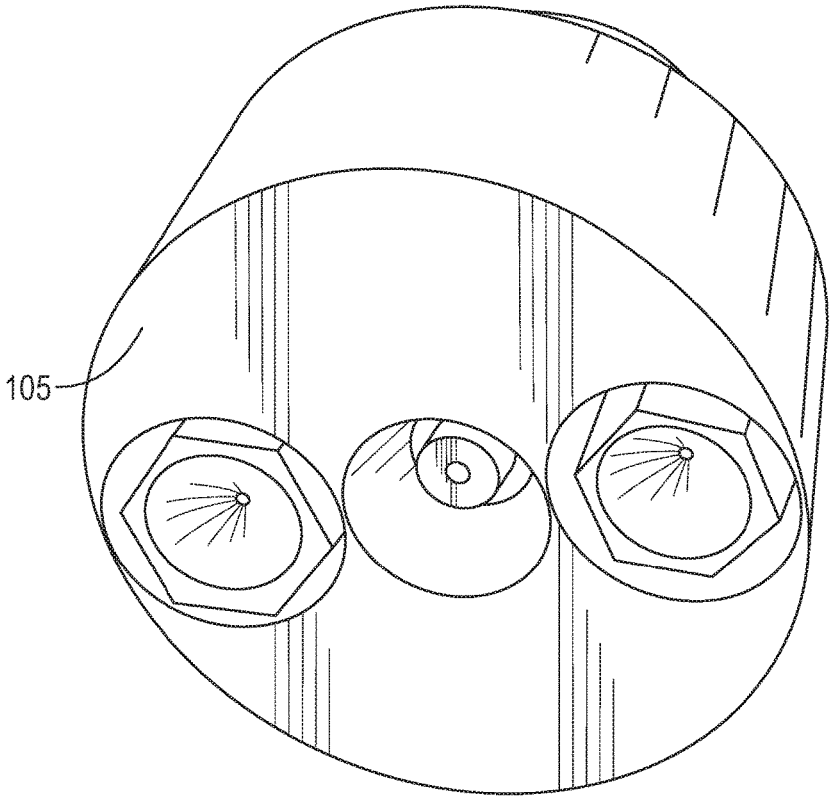
FIG. 15 is a view in partial perspective of an exemplary nozzle.

Additionally, one or more value packs 62 may be disposed at least partially within interior void 16 where each value pack 62 is configured to provide an additional hull cleaning system function, by way of example and not limitation such as hydraulic power for diver held brush for use by diver 500 (FIG. 14) or water jet systems.

Subsea structure cleaning system 1 may further comprise one or more inspection sensors 63 which may comprise one or more wheel encoders, eddy current sensors, or the like, or a combination thereof. Typically, inspection sensors 63 are connected to wiper arm-cleaner 50 and allow for inspection of weld integrity, hull, coating or fouling thickness Referring additionally to FIG. 6 and FIG. 7, cage 90 may be part of an overall cleaning system and configured to selectively and releasably contain housing 10. Similarly, winch 91 may be operatively connected to cage 90 and operate to raise and/or lower cage 90. Cage 90 may be used to assist by managing tether chafing, provide or otherwise augment tether water cooling, allow vehicle hydrodynamic loading, or the like, or a combination thereof. In certain embodiments, cage geometry, e.g. width, may allow for a higher profile vehicle.

Figure 8:
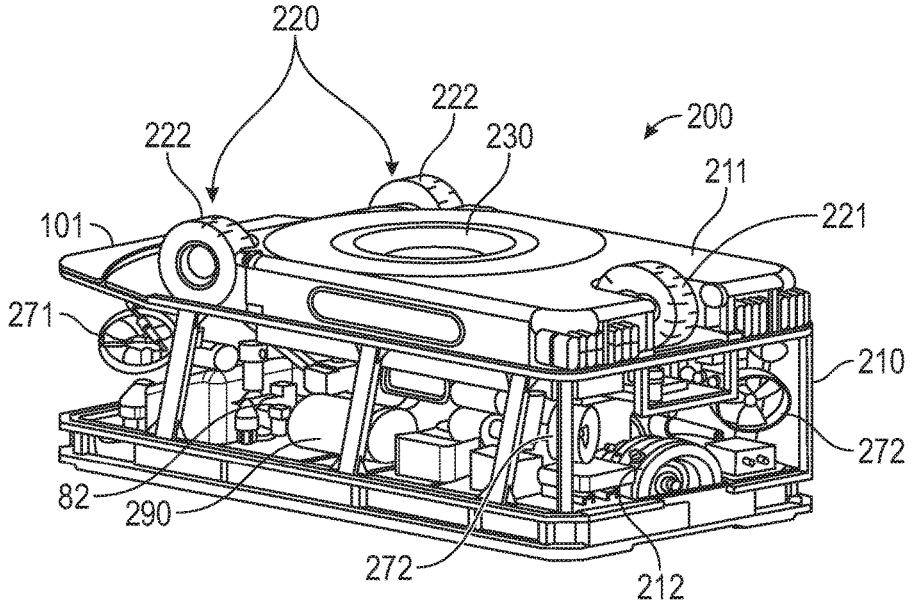
FIG. 8 is view in partial perspective of another exemplary embodiment of a vessel hull cleaning apparatus.
Figure 9:
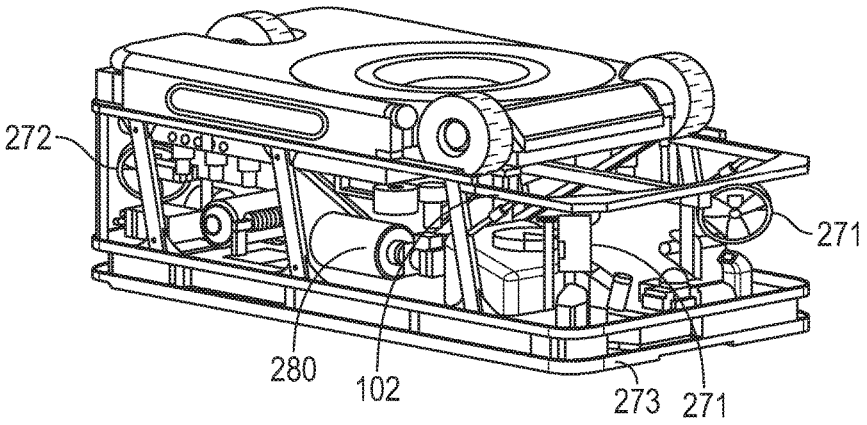
FIG. 9 is view in partial perspective of another exemplary embodiment of a vessel hull cleaning apparatus.

In a second embodiment, referring generally to FIG. 8 and FIG. 9, underwater remotely operated work class (ROV) 200 comprises frame 210, one or more inspection sensors 263 disposed about frame 210, hydraulically powered high pressure water jet pump 212 connected to frame 210, predetermined tooling set 265 (FIG. 11) connected to housing 210, and propulsion system 220 connected to housing 210. In certain embodiments, propulsion system 220 is adapted to propel housing 210 about a surface such as a vessel hull 2 (FIG. 11) or a subsea structure such as a riser.

ROV 200 may also comprise ballast system 211, which may be a variable ballast system, configured to help achieve vehicle orientation ROV 200 is typically able to be deployed from any platform outfitted to accept its launch, recovery and support equipment and may further be innately unstable when not adhered to and underwater structure and flying through open water.

Propulsion system 220 typically comprises one or more thrusters such as one or more front thruster 271 and one or more rear thrusters 272. If thrusters are configured, ROV 200 may be configured to be operated remotely in a free flying swimming mode with such thrusters.

Figure 3:
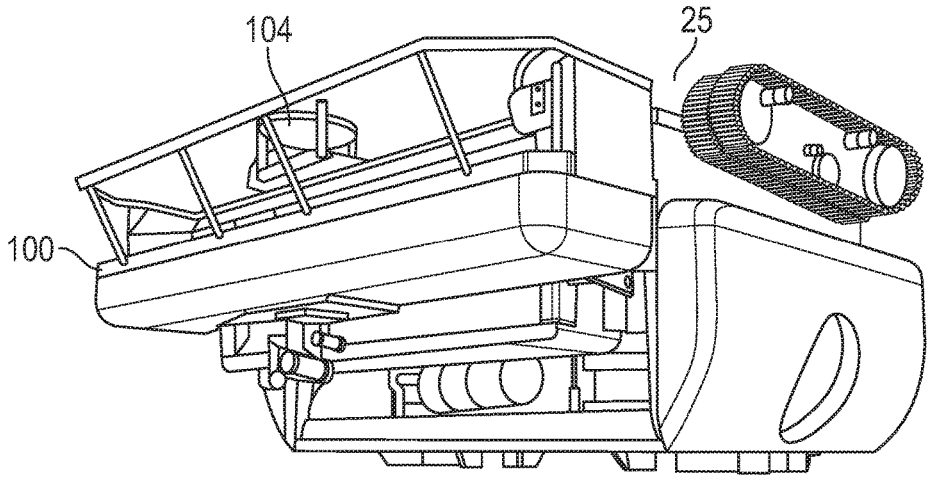
FIG. 3 is view in partial perspective of a side of an exemplary embodiment of a vessel hull cleaning apparatus illustrating a track.

In other embodiments, propulsion system 220 comprises suction device 230 and a set of driving wheels 222 or track similar to track 25 (FIG. 3). In such embodiments, ROV 200 may be configured to be operated remotely about a surface such as vessel hull 2 (FIG. 11) or a subsea structure such as a riser in an attached driving mode using suction device 230 and a set of driving wheels 222. Hydraulically powered high pressure water jet pump 212 may be remotely controlled with respect to water pressure and flow rate.

Figure 12:
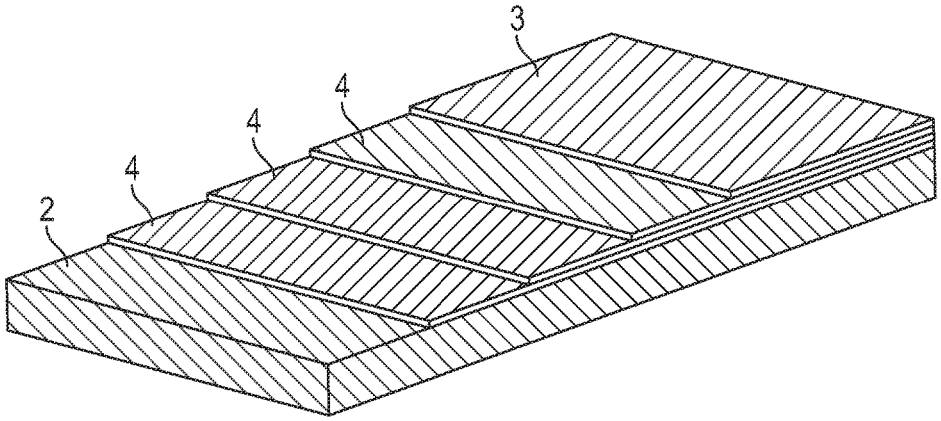
FIG. 12 is view in partial subsection of a hull and its layers.
Figure 13:
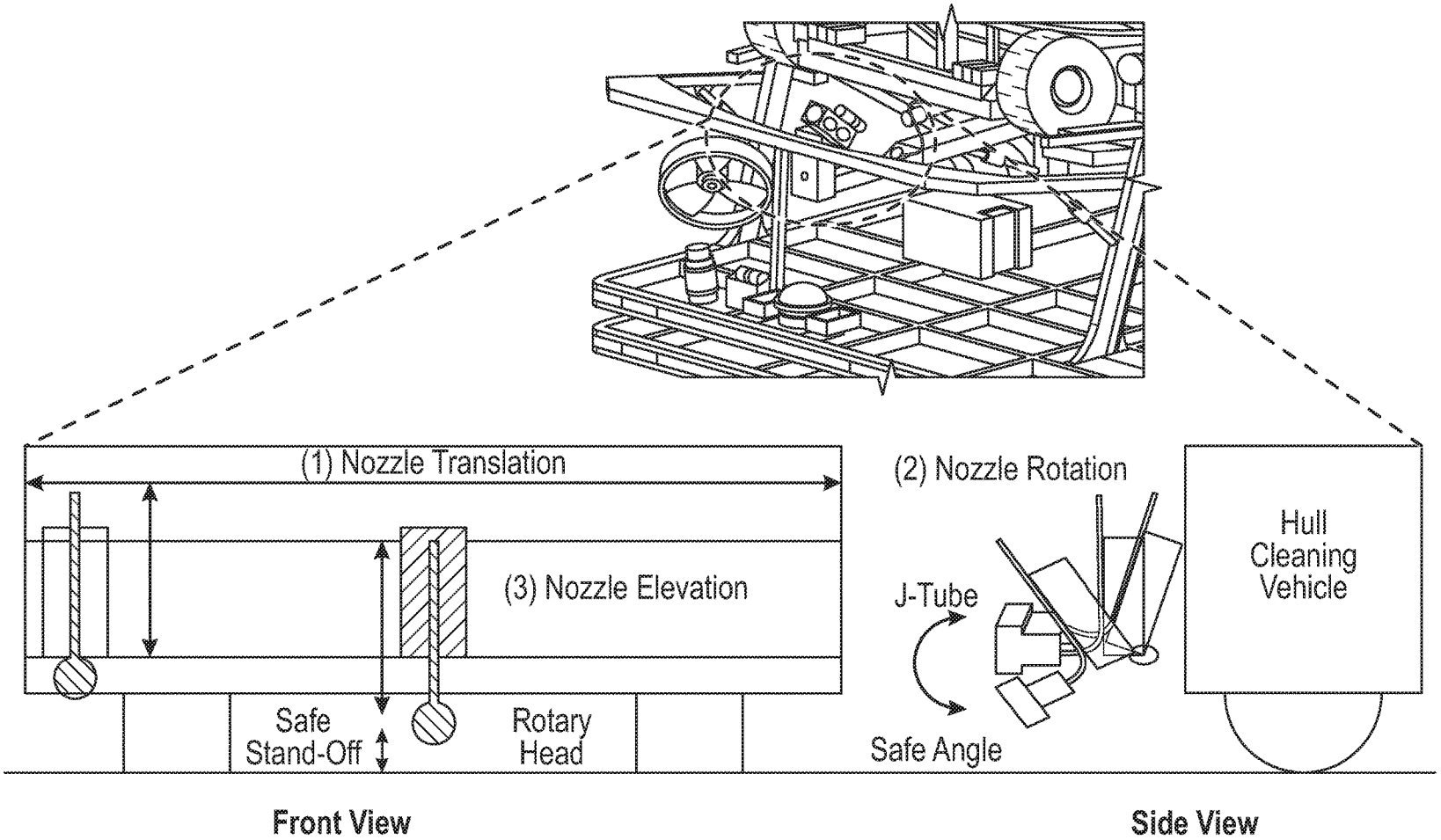
FIG. 13 is view in partial perspective of another exemplary embodiment of a vessel hull cleaning apparatus with an explanatory set of views.

As with subsea structure cleaning system 1, ROV 200 may comprise a surface cleaning and inspection capability such a capability to remove fouling for submerged surfaces and/or inspect underwater surfaces. By way of example and not limitation, such surface cleaning and inspection capability may be configured to remove a predetermined quantity of marine growth 3 (FIG. 12) from vessel hull 2 (FIG. 12) without damaging or removing an underlying, firmly adhered, protective coating such as layers 4 (FIG. 12). In other configurations, the surface cleaning and inspection capability may be configured to remove marine growth and corroded metal from horizontal, vertical, and overhead surfaces. Additionally, the surface cleaning and inspection capability may be configured to be able to inspect horizontal, vertical, and overhead metal surfaces for thickness, corrosion, weld defects using various sensors and visual methods.

By way of further example and not limitation, surface inspection capability may further comprise cathodic protection inspection capability, material thickness inspection capability, alternating current field and eddy current measurement inspection capability, and the like, or a combination thereof.

To accomplish the surface cleaning and inspection capability, tooling set 265 (FIG. 11) may comprise one or more tools configured to achieve the surface cleaning and/or inspection functions. By way of example and not limitation, additional tools may be present and configured to remove marine growth and corroded metal from different surface materials using hydraulically powered high pressure water jet pump 212 which has been configured to use filtered salt water, brackish water, and/or fresh water as feed water. If using fluids such as water, hydraulically powered high pressure water jet pump 212 is typically configured to provide fluid pressure conveyed through fixed or rotating conventional nozzles 252 and/or cavitating water jet nozzles 251.

Figure 4:
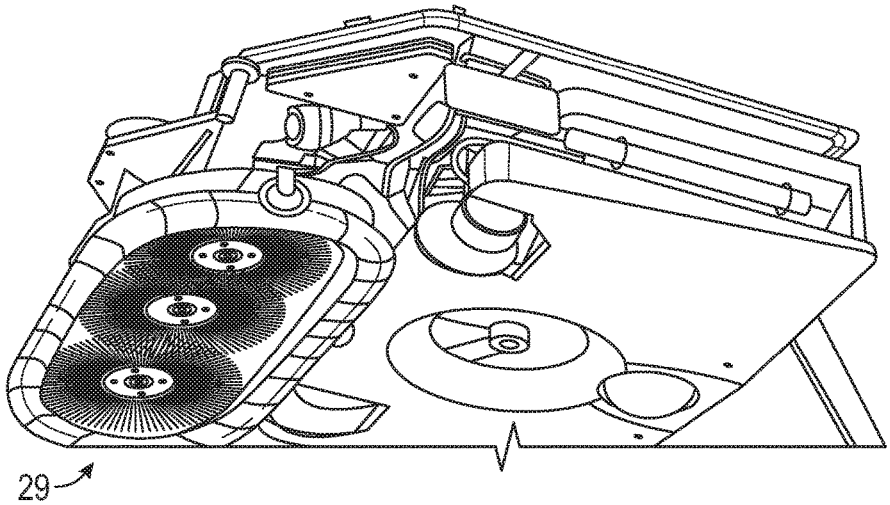
FIG. 4 is view in partial perspective of a side of an exemplary embodiment of a vessel hull cleaning apparatus illustrating brushes.

Tooling set 265 (FIG. 11) may also, either in addition or as a separate configuration, comprise one or more tools configured to achieve the surface cleaning and/or inspection functions such as a set of rotating mechanical brushes similar to brushes 29 (FIG. 4), which may be of various designs, suitable for various densities of marine growth removal from various surfaces. The set of rotating mechanical brushes may be remotely controlled with respect to brush speed and torque and/or brush stand-off height Tooling set 265 (FIG. 11) may also, either in addition or as a separate configuration, comprise a set of remotely adjustable height fixed blades configured to remove significant quantities of marine growth from flat and curved surfaces.

Figure 10:
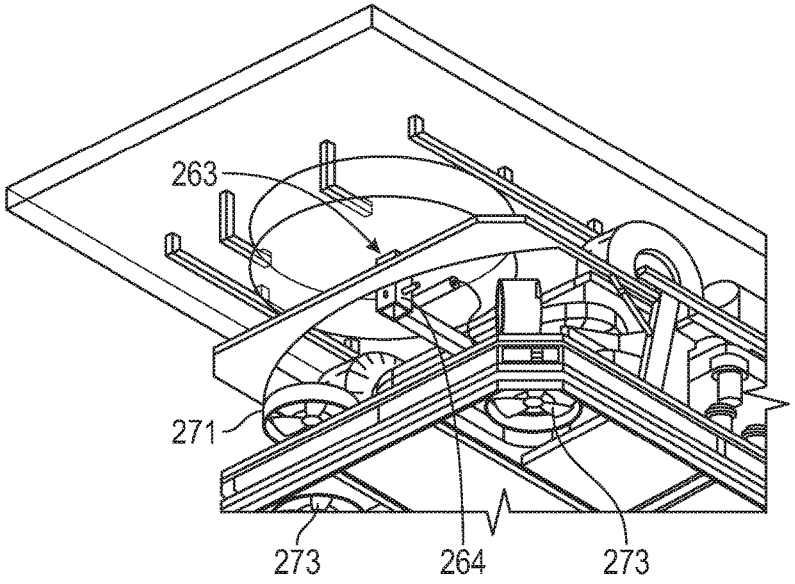

Referring additionally to FIG. 10 and FIG. 11, in further configurations, ROV 200 further comprises one or more multi-degree-of-freedom arms 264 which may be configured to be able to extend and retract a device such as high pressure water jet nozzle 252 into piping for some distance. Multi-degree-of-freedom arm 264 may comprise end effector 265 (FIG. 7) configured to allow positioning of a high pressure water jet similar to cavitating water jets 51 (FIG. 5) or rotary brush similar to brushes 29 (FIG. 4) such as are described above in the first embodiment. These high pressure water jets and/or rotary brushes may be configured to clean surfaces made of different materials, remove growth from flat surfaces, remove growth from elevated surfaces, and/or remove growth from internal access ports such as sea chests, piping, and masker belts and the like.

ROV 200 may further comprise a set of tandem vertical thrusters 273 configured to control the roll and pitch of ROV 200 during flight. In addition, the combination of thrusters 271, 272, and 273 and a large central counter rotating thruster such as suction device 230 may be used to achieve stability in flight.

Suction device 230 may be configured as a contra-rotating propulsor configured to aid in achieving surface adhesion and removing rotational torque from ROV 200.

ROV 200 may comprise control system 400 configured to enable flight in multiple modes, such as when ROV 200 is mid-water or traveling on a submerged surface and/or feature based navigation or the like, or a combination thereof. By way of example and not limitation, feature based navigation may comprise free ranging on grid (FROG) technology for submerged navigation and/or mapping a surface to be cleaned by using sensors such as inspection sensors 263 (FIG. 10). Additionally, feature based navigation may be configured to be programmed with automated cleaning patterns which may allow repeatable on-hull navigation.

Although differing in their embodiments, overall configuration of ROV 200 and subsea structure cleaning system 1 are similar.

Figure 7:
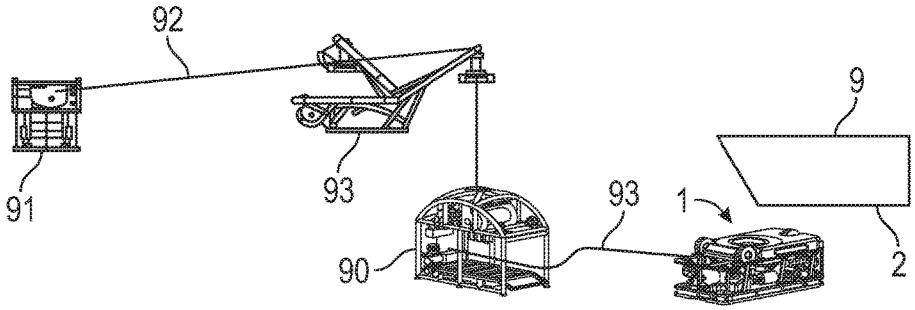
FIG. 7 is view in partial perspective and in block form of an exemplary embodiment of a vessel hull cleaning system.

In the operation of exemplary embodiments, referring generally to FIG. 7, a surface such as vessel hull 2 (FIG. 11) may be cleaned subsea by maneuvering subsea structure cleaning system 1 proximate a subsea structure 2 to be cleaned subsea such as vessel hull, where subsea structure cleaning system 1 is as described herein.

If cage 90 is present, maneuvering subsea structure cleaning system 1 may comprise deploying subsea structure cleaning system 1 in cage 90 such as from a surface location and allowing subsea structure cleaning system 1 to exit cage 90 and transit from cage 90 to a work area. Optionally, subsea structure cleaning system 1 may be returned to and dock into cage 90 after completing the inspection and/or cleaning.

When in a desired location, subsea structure cleaning system 1 may then be landing on a bottom portion of the hull, e.g. vessel hull 2 (FIG. 11), without damaging vessel 9. Moreover, once in position, subsea structure cleaning system 1 may be maneuvered for adhesion to a bottom surface of vessel 9, e.g. vessel hull 2, and adhered to vessel hull 2 using impeller 31. This may include maneuvering and rotating subsea structure cleaning system 1 approximately 90 degrees for side adhesion.

Once positioned, subsea structure cleaning system 1 may be navigated about vessel hull 2 using propulsion system 20 (FIG. 1), by way of example and not limitation by using wheels 21 and 22 (FIG. 1). During traverse, vessel hull 2 may be inspected and, if and as necessary, cleaned. By way of example and not limitation, areas for cleaning may include sea chest exterior grates, anodes, and other areas proud of hull 2. Traversal may be aided by using one or more inspection sensors 63, cameras, or the like, or a combination thereof.

As will be familiar to those of ordinary skill in subsea growth removal, by way of example and not limitation marine hard growth can comprise fire coral, barnacles, shells, and the like. By way of further example and not limitation, soft growth can comprise soft fouling-tube worms, sea grass, and the like. Typically, if a soft topcoat such as layer 3 (FIG. 12) with fouling, such as including imbedded hard fouling, is found, the fouling may be removed using one or more cleaners 50. This may comprise using one or more cavitating water jets 51 for removing marine growth in areas that cannot be cleaned with aggressive brushes without risking damage to the underlying coatings or alteration of the surface appearance, using one or more aggressive brushes 29 for lighter fouled areas or situations where paint damage is not a concern, or the like, or a combination thereof.

If top coat 3 (FIG. 12) of vessel hull 2 is properly adhered, top coat 3 is typically not removed during inspection and/or cleaning. If top coat 3 is in need of cleaning, e.g. it is covered in bio-fouling, a corrosion protective primer such as layer 4 (FIG. 12), if present, is typically not removed but the area needing cleaning, e.g. bio-fouling, is removed during cleaning. If any top coat 3 is adhered to the fouling, top coat 3 may also be removed.

If so equipped, sonar 61 may be configured to allow sonar triangulation using range/bearing and known geometry of hull 2 and/or risers which can provide vehicle position and orientation.

The foregoing disclosure and description of the invention is illustrative and explanatory. Various changes in the size, shape, and materials, as well as in the details of the illustrative construction and/or an illustrative method may be made without departing from the spirit of the invention.

What is claimed is:

1. A subsea structure cleaning system, comprising:

a. a housing configured for use subsea, the housing comprising an upper side, a front side, and an interior void;

b. a propulsion system disposed about a predetermined portion of the upper side of the housing;

c. a power system disposed at least partially within the interior void;

d. a positioning system operatively connected to the power system;

e. a multifunction bar extending from the front side portion of the housing, the multifunction bar comprising a cleaning tool configured to perform a predetermined cleaning function;

f. a water pump disposed at least partially within the interior void and operatively connected to the power system;

g. a manifold disposed at least partially within the interior void and operatively in fluid communication with the water pump;

h. a subsea structure cleaner; and i. a suction device disposed at least partially within the housing and comprising an exposed surface, the suction device configured to selectively adhere the subsea structure cleaning system to a subsea structure, the suction device comprising an impeller.

2. The subsea structure cleaning system of claim 1, wherein the subsea structure cleaning system is configured to be controllably buoyant.

3. The subsea structure cleaning system of claim 1, wherein the propulsion system comprises:

a. a first wheel configured to be steerable and extending outward from the housing with respect to the interior void; and b. a second wheel configured as a driven wheel extending outward from the housing with respect to the interior void.

4. The subsea structure cleaning system of claim 3, wherein the propulsion system comprises:

a. a wheel driver operatively connected to the driven wheel of the set of wheels; and b. a wheel driver controller operatively in communication with the wheel driver, the wheel driver controller configured to provide multiple driving modes.

5. The subsea structure cleaning system of claim 1, wherein the propulsion system comprises a crawling track configured to provide controlled movement of the housing on a vessel hull.

6. The subsea structure cleaning system of claim 1, wherein the cleaning tool configured to perform the predetermined cleaning function comprises at least one of a hard fouling scraper and/or a tool carrier interchange adapted to accept a rotary brush, a rotary nozzle, or a liner brush/grinder.

7. The subsea structure cleaning system of claim 1, wherein the subsea structure cleaner comprises at least one of a brush or a cavitating water jet configured for use in floating production, storage and offloading cleaning to support an underwater inspection in lieu of drydocking task.

8. The subsea structure cleaning system of claim 1, further comprising a wiper arm-high pressure (HP) cleaner water cleaner configured to be movable in two directions, the wiper arm-HP water cleaner comprising a nozzle carrier interchange.

9. The subsea structure cleaning system of claim 8, wherein the nozzle carrier interchange is configured to accept at least one of rotary head, a telescoping nozzle, an inspection sensor carrier, or a riser cleaning tool.

10. The subsea structure cleaning system of claim 1, wherein the impeller comprises a suction impeller configured to allow adherence of the housing to vertical as well as horizontal hull surfaces.

11. The subsea structure cleaning system of claim 1, wherein the impeller is configured to provide vertical thrust.

12. The subsea structure cleaning system of claim 1, further comprising an inspection sensor.

13. The subsea structure cleaning system of claim 1, further comprising a sonar configured to allow sonar triangulation using range/bearing and known geometry of hulls and risers to provide vehicle position and orientation.

14. The subsea structure cleaning system of claim 1, wherein the subsea structure cleaner comprises a tool carrier interchange configured to position the subsea structure cleaner for cleaning a subsea structure and to accept at least one of a cleaning tool configured to remediate bio-fouling or a manipulator.

15. The subsea structure cleaning system of claim 1, wherein the subsea structure cleaning system is configured to be deployed as either a work-class ROV capable support vessel or a standalone, host independent system.

16. A method of cleaning a subsea structure, comprising:

a. maneuvering a subsea structure cleaning system proximate a vessel hull to be cleaned subsea, the subsea structure cleaning system comprising:

i. a housing configured for use subsea, the housing comprising an upper side, a front side, and an interior void;

ii. a propulsion system disposed about a predetermined portion of the upper side of the housing;

iii. a power system disposed at least partially within the interior void;

iv. a positioning system operatively connected to the power system;

v. a multifunction bar extending from the front side portion of the housing, the multifunction bar comprising a cleaning tool configured to perform a predetermined cleaning function;

vi. a water pump disposed at least partially within the interior void and operatively connected to the power system;

vii. a manifold disposed at least partially within the interior void and operatively in fluid communication with the water pump;

viii. a subsea structure cleaner; and ix. a suction device disposed at least partially within the housing and comprising an exposed surface, the suction device configured to selectively adhere the subsea structure cleaning system to a subsea structure, the suction device comprising an impeller;

b. landing the subsea structure cleaning system on a bottom portion of the vessel hull without damaging the vessel;

c. adhering the subsea structure cleaning system to the vessel hull using the suction device;

d. navigating the subsea structure cleaning system about the vessel hull using the wheels;

e. inspecting the vessel hull;

f. if a top coat of the vessel hull is properly adhered, not removing the top coat;

g. if the top coat is covered in bio-fouling, removing bio-fouling and any top coat that is adhered to the bio-fouling.

17. The method of cleaning a vessel hull of claim 16, wherein a corrosion protective primer is not removed if the top coat is removed.

18. The method of cleaning a vessel hull of claim 16, further comprising removing a soft topcoat with imbedded hard fouling.

19. The method of cleaning a vessel hull of claim 16, wherein the subsea structure cleaning system further comprises a manipulator arm operatively connected to a cavitating water jet, the method further comprising:

a. using the cavitating water jet for removing marine growth on vessel hull areas that cannot be cleaned with aggressive brushes without risking damage to the underlying coatings or alteration of the surface appearance; and b. using an aggressive brush for lighter fouled on vessel hull areas or in situations where paint damage is not a concern.

* * * * *